US009314114B2

(12) United States Patent
Davis

(10) Patent No.: US 9,314,114 B2
(45) Date of Patent: Apr. 19, 2016

(54) DEVICE FOR ASSISTED WALKING

(71) Applicant: Inspire Create LLC, Chula Vista, CA (US)

(72) Inventor: Shannon Marie Davis, Chula Vista, CA (US)

(73) Assignee: INSPIRE CREATE LLC, Chula Vista, CA (US)

( * ) Notice: Subject to any disclaimer, the term of this patent is extended or adjusted under 35 U.S.C. 154(b) by 0 days.

(21) Appl. No.: 14/592,650

(22) Filed: Jan. 8, 2015

(65) Prior Publication Data

US 2015/0196134 A1 Jul. 16, 2015

Related U.S. Application Data

(60) Provisional application No. 61/926,189, filed on Jan. 10, 2014.

(51) Int. Cl.

| | |
|---|---|
| ***A47D 13/04*** | (2006.01) |
| ***A61H 3/00*** | (2006.01) |
| ***A47D 13/00*** | (2006.01) |

(52) U.S. Cl.

CPC ..... *A47D 13/04* (2013.01); *A47D 13/00* (2013.01); *A61H 3/00* (2013.01)

(58) Field of Classification Search

CPC ..... A47D 13/00; A47D 13/04; A61H 3/00

USPC ..... 108/27; 135/67; 280/87.051; 482/51, 66

See application file for complete search history.

(56) References Cited

U.S. PATENT DOCUMENTS

| | | | | | |
|---|---|---|---|---|---|
| 265,432 | A * | 10/1882 | Peterson | A61H 3/00 | 482/66 |
| 2,657,735 | A * | 11/1953 | Hughes | 297/5 | |
| 2,667,207 | A * | 1/1954 | Magyar | A47D 1/004 | 108/11 |
| 2,695,656 | A * | 11/1954 | Wagman | 297/138 | |
| 2,817,387 | A * | 12/1957 | Blake | 135/67 | |
| 3,055,722 | A * | 9/1962 | Chase et al. | 108/27 | |
| 3,777,673 | A * | 12/1973 | Blazey | A47B 13/08 | 108/27 |
| 4,708,274 | A * | 11/1987 | Roche | 224/407 | |
| 5,033,734 | A * | 7/1991 | Jalbert | 482/66 | |
| 5,120,286 | A * | 6/1992 | Twohig | 482/66 | |
| 5,592,884 | A * | 1/1997 | Glick | A47B 37/00 | 108/25 |
| 6,196,949 | B1 * | 3/2001 | Rodarte | 482/69 | |
| 7,712,477 | B2 * | 5/2010 | McCarthy | 135/67 | |
| 7,730,841 | B2 * | 6/2010 | Wang | A47B 13/12 | 108/153.1 |

(Continued)

FOREIGN PATENT DOCUMENTS

WO WO 2008106459 A1 * 9/2008 ..... A47D 13/04

*Primary Examiner* — Noah Chandler Hawk

(74) *Attorney, Agent, or Firm* — Procopio, Cory, Hargreaves & Savitch, LLP

(57) ABSTRACT

A device for assisted walking is disclosed. The device may have a substantially flat top section having a plurality of corners, a plurality of sides, and a first perimeter. The device may have a raised border formed about the first perimeter, the raised border defining a top perimeter greater than the first perimeter. The device may have a plurality of support legs, each support leg of the plurality of support legs having one of a plurality of feet. Each foot of the plurality of feet may be disposed at a distal end of each support leg of the plurality of support legs. Each foot of the plurality of feet may have a rounded bottom portion in contact with a floor, each bottom portion having foot width greater than the leg width, and defining a base perimeter greater than the top perimeter, the rounded bottom portion configured to slide along the floor.

20 Claims, 12 Drawing Sheets

(56) References Cited

U.S. PATENT DOCUMENTS 8,245,649 B1 * 8/2012 Ratliff et al. ..... 108/25
2007/0006781 A1 * 1/2007 Xiang ..... A47B 13/12 108/27
2008/0121259 A1 * 5/2008 Weaver ..... 135/67

* cited by examiner

DEVICE FOR ASSISTED WALKING

INCORPORATION BY REFERENCE TO ANY PRIORITY APPLICATIONS

This application claims the benefit of U.S. Provisional Application No. 61/926,189, entitled DEVICE FOR ASSISTED WALKING, filed Jan. 10, 2014, which is hereby incorporated by reference in its entirety.

BACKGROUND

1. Technological Field

This disclosure is generally related to devices used for assisted walking. The disclosure relates more specifically to an apparatus for training individuals to walk and support themselves.

2. Background

Certain products exist to allow parent and caregivers options for teaching individuals under their care to walk. Parents have certain "walker" options for their children. Caregivers and therapists use similar concepts for patients or clients in their charge.

Some products exist that assist a user such as an infant in reaching developmental milestones or an adult undergoing therapy. Few suitable options exist. Such options may include products designed for a supported stander, supported walker, and an unsupported push walker with wheels. However such products may not present the best possible product options for the parent or caregiver.

SUMMARY

One aspect of the disclosure provides a device for assisted walking. The device can have a substantially flat top section having a plurality of corners, a plurality of sides, and a first perimeter. The device can also have a raised border formed about the first perimeter. The raised border can define a top perimeter greater than the first perimeter. The device can also have a plurality of support legs, each support leg of the plurality of support legs disposed at each of the plurality of corners. The plurality of support legs can extend in substantially the same direction away from the top section and each of the plurality of corners. The plurality of support legs can each having a leg width. The device can also have plurality of feet. Each foot of the plurality of feet can be disposed at a distal end of each support leg of the plurality of support legs. The distal end can be distal to the top section. Each foot of the plurality of feet can have a rounded bottom portion. Each bottom portion can have a foot width greater than the leg width and collectively can define a base perimeter greater than the top perimeter. The rounded bottom portion can be configured to slide along the floor.

Another aspect of the disclosure provides a method for training an infant to walk. The method can include gripping a raised border of a walker device. The walker device can include a substantially flat top surface having a plurality of corners and a first perimeter. The walker device can also have the raised border formed about the first perimeter, the raised border having a first width and defining a top perimeter greater than the first perimeter. The walker device can also have a support leg disposed on a bottom side of the top surface extending downward from each of the plurality of corners. The support leg having a leg width. A foot can be disposed at a distal end of the support leg, each foot having a rounded bottom portion in contact with a floor. Each bottom portion can have foot width greater than the leg width and define a base perimeter greater than the top perimeter. The rounded bottom portion can exhibit a low friction relationship with the floor. The method can also include pulling the upper body up toward the edge as the infant stands up. The method can also include leaning on the top surface with hands or arms. The method can also include transferring the bodyweight of the infant to the hands or arms in contact with the top surface. The method can also include pushing the walker device along the floor.

Another aspect of the disclosure provides a device for assisted walking. The device can have a substantially flat top section having four of corners, four sides, and a first perimeter. The device can also have a raised border formed about the first perimeter, the raised border defining a top perimeter greater than the first perimeter. The device can also have four side supports configured to contain and support the top section by a clearance fit, the clearance fit permitting the top section to rattle within the four side supports when impacted by a percussive force. The device can also have four support legs. Each of the four support legs can be disposed at each of the four corners. The four support legs can extend downward from the top section and each of the four corners. The four support legs each can have a leg width. The device can also have four feet, each of the four feet disposed at a distal end of each of the four support legs, the distal end being distal to the top section. Each of the four feet can have a rounded bottom portion in contact with a floor. Each bottom portion can have a foot width greater than the leg width and define a base perimeter greater than the top perimeter. The rounded bottom portion can be configured to slide along the floor.

Other features and advantages of the present invention should be apparent from the following description which illustrates, by way of example, aspects of the invention.

DESCRIPTION OF THE DRAWINGS

The details of embodiments of the present invention, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the invention may be practiced. The detailed description includes specific details for the purpose of providing a thorough understanding of the embodiments. In some instances, well-known structures and components are shown in simplified form for brevity of description.

The embodiments described in this disclosure generally relate to devices for assisted walking. Certain assisted walking devices may be used by small children such as infants or toddlers (referred to herein as a "user") learning to walk and support themselves. Certain embodiments may further be used for larger children or adults undergoing certain physical therapy or occupational therapy regimens.

Figure 1:
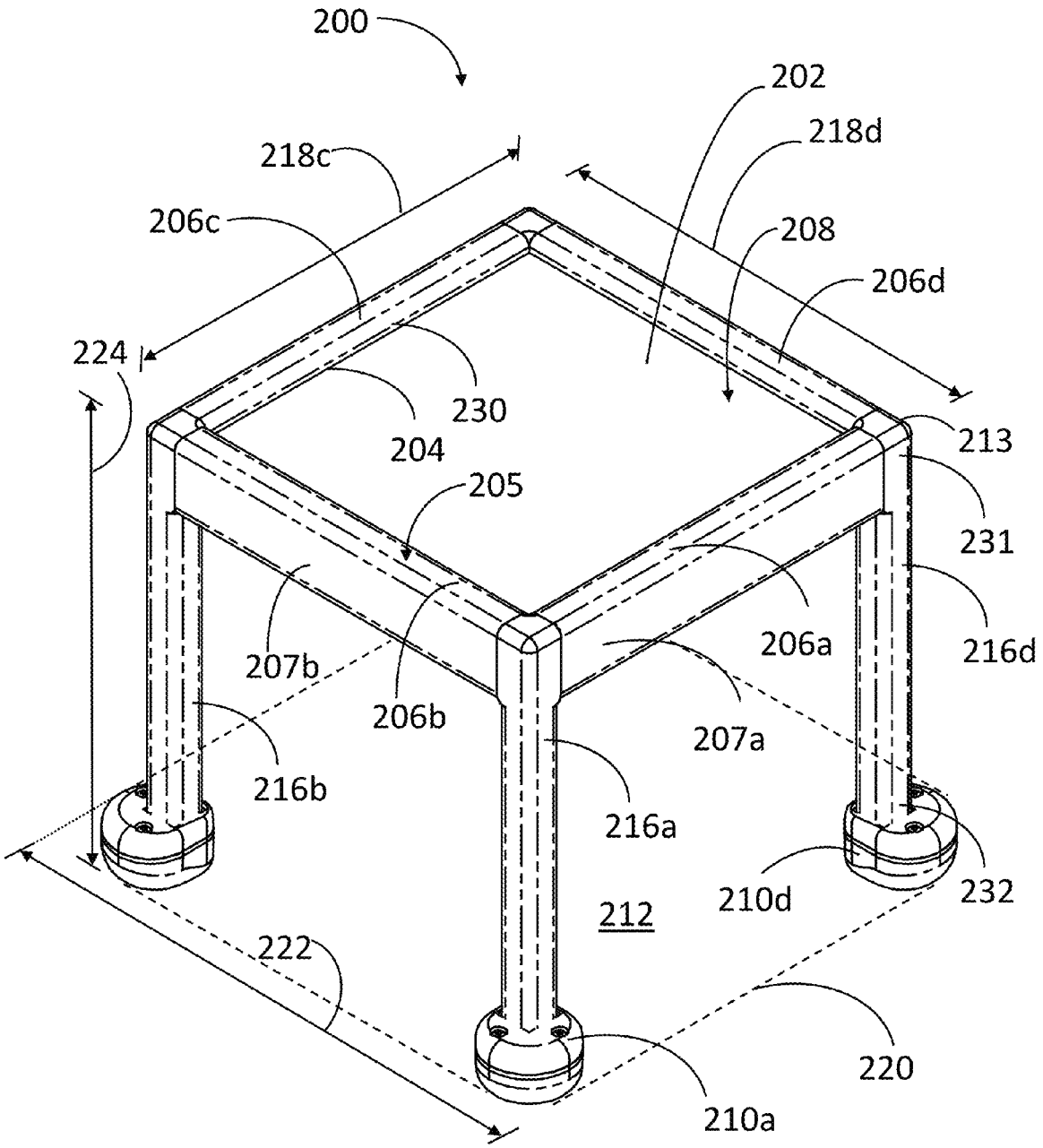
FIG. 1 is a perspective view of a device for assisted walking.

FIG. 1 is a perspective view of a device for assisted walking 200 (referred to hereinafter as the "device 200"). An embodiment of the device 200 has a top section 202. The top section 202 has a plurality of sides 203 (shown in FIG. 3) and a substantially flat, substantially rectangular top surface 208. For example, the device 200 may have four sides 203 for a rectangle. The sides 203 of the top section 202 may be partially contained and supported within a side support 207*a*-207*d* (collectively referred to hereinafter as "the side supports 207") of the device 200. This aspect is described further in connection with FIG. 3.

In an embodiment, the top section 202 has a first perimeter 204 defined by a plurality of raised borders 206*a*-206*d* (collectively referred to hereinafter as raised borders 206) on each side of the top section 202. The raised borders 206 form an upper portion of a corresponding side support 207*a*-207*d* (collectively referred to hereinafter as "side supports 207"). The side supports 207 can provide structural support to the device 200 and may be formed to receive the top section 202 (shown in FIG. 3). As shown, the outer dimensions of the four raised borders 206 may describe a second perimeter or "top perimeter" 213 of the device 200.

The device 200 may further comprise a plurality of support legs 216*a*-216*d* (collectively referred to hereinafter as "support legs 216"). Each of the support legs 216 may be connected to two of the side supports 207, as shown. For example, the support leg 216*a* may be connected to the side supports 207*a*, 207*b* at a proximal end 231 by an interference fit (described below) or by various fasteners, such as bolts, nails, or screws.

Each of the support legs 216 may extend orthogonally away from the top section 202 and the side supports 207, toward a floor 212 (shown in FIG. 4), for example. In an embodiment, the top section 202 may be a rectangular or square shape with each of the support legs 216 being disposed at the corners of the top section 202. The support legs 216 may each be formed to join with two adjacent side supports 207 and with the top section 202 (described below in connection with FIG. 6). As shown in FIG. 1, the device 200 is substantially square, having four support legs 216 disposed at each of the four corners of the top section 202 and the ends of the side supports 207. The support leg 216*d* is not shown due to the perspective of FIG. 1.

The device 200 may further comprise a plurality of feet 210*a*-210*d* (collectively, feet 210) affixed or otherwise formed to a distal end 232 of the support legs 216. The feet 210 may be in direct contact with the floor 212. The feet 210 may have a rounded shape and provide a surface that may slide along the floor 212 when a force is applied to one of the sides of the device 200. As noted with the leg 216*d* above, the foot 210*d* is not shown due to the perspective of FIG. 1. In some embodiments, for example, the device 200 may resemble a small table that can be pushed by the intended user.

In an embodiment, the top surface 208 of the device 200 may be substantially square, each side having an equal top dimension 218*a*-218*d* (collectively referred to hereinafter as "top dimensions 218"). Accordingly, the top perimeter 213 may also be described by the top dimensions 218. In some embodiments, each of the top dimensions 218 may be equal. In another embodiment, opposing top dimensions (e.g., 218*a*, 218*c* and 218*b*, 218*d*) may be equal, providing a rectangular top perimeter 213.

Figure 2:
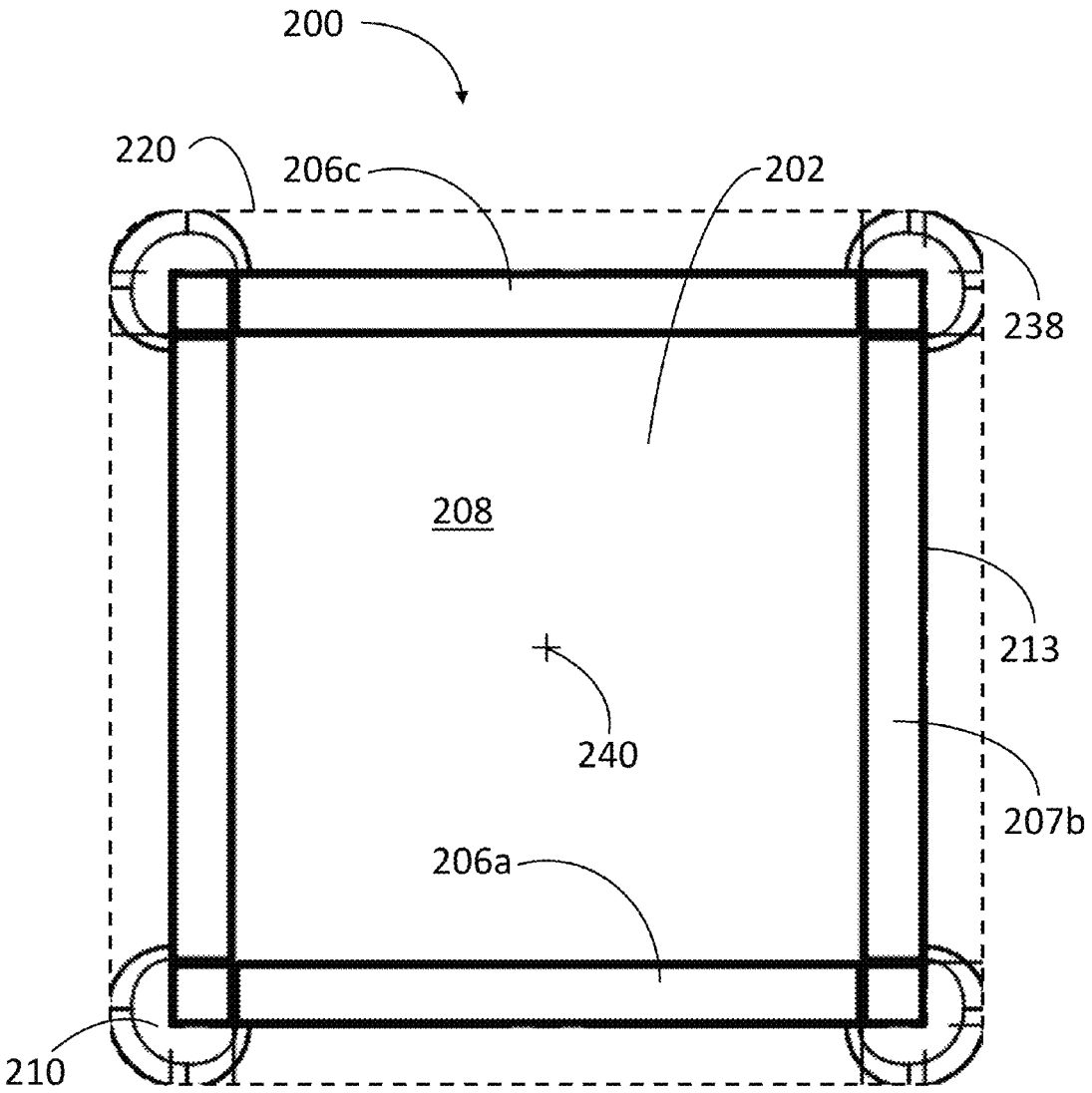
FIG. 2 is a top plan view of the device of FIG. 1.

The device 200 may also have a base perimeter 220 (shown in a dashed line). The base perimeter 220 can be defined by an outer most point of each of the feet 210, as shown in FIG. 2, below. The base perimeter 220 may be proportional to the top perimeter 213. Accordingly, the base perimeter 220 may also be substantially square, having base dimensions 222*a*-222*d* (collectively referred to hereinafter as "base dimensions 222"). In an embodiment, the base dimensions 222*a*-222*d* may be equal. In another embodiment, the dimensions 222*a* and 222*c* may be equal and the base dimensions 222*b* and 222*d* may be equal providing a rectangular base perimeter 220 corresponding to a rectangular top perimeter 213.

In some embodiments, the base dimensions 222 are generally larger than the top dimensions 218. Accordingly, the base perimeter 220 may be generally larger than the top perimeter 213 providing a side profile having an overall "trapezoidal" shape (shown in FIG. 4) when viewed from any side. Such a trapezoidal shape may lower the center of gravity of the device 200, increasing the stability of device 200 in use. In an embodiment, such a shape may also be referred to as a pyramidal frustrum as described below.

The device 200 further has a height dimension 224. The height dimension 224 as well as the top dimensions 218 and the base dimensions 222 may be adjusted for the height of the intended user.

As a non-limiting example, the device 200 may have top dimensions 218 of approximately 12 inches square as compared to an exemplary base dimension 222 of 14 inches square, creating the profile with the trapezoidal shape. The larger dimensions of the base perimeter 220 may be achieved by enlarging the feet 210 at the distal end 232 of each support leg 216. This may be accomplished by varying the size of the feet 210. The overall trapezoidal shape may serve to increase the stability of the device 200 in all planes with the surface area of the base of the device 200 being larger than that of the top section 202. In another embodiment, the trapezoidal profile is also possible by angling the support legs 216 away from the center of the device 200.

In some embodiments, the size of the device 200 may be reduced for smaller users, in the case of an infant or toddler. However, when the device 200 is implemented by larger children or adults, modification of the dimensions or top section, the top perimeter 213, the base perimeter 220, and the height dimension 224 may be required.

In an embodiment, the device 200 may be scaled up for larger infants or even for use with adults. For example, the device 200 may have dimensions as large as 30 inches by 30 inches or larger, providing various physical therapy or occupational therapy options for larger children and adults. Accordingly, the height dimension 224 of the device 200 and of the support legs 216 may also be scaled up accordingly.

In some embodiments, a generally uniform construction of the device 200 is contemplated. Such a uniform construction may provide uniform stability from one side of the device 200 to another side. Furthermore, a substantially square form also maximizes the amount of usable surface area on the top surface 208. This may allow the user to transport certain objects (e.g., toys) in use.

In some other embodiments, non-square or non-rectangular dimensions may be possible or desired for different implementations. Other such polygonal shapes (e.g., triangular, rectangular, etc.) may require addition of an equal number of support legs 216 and feet 210. In other embodiments, equal distribution of the support legs 216 (e.g., four support legs 216) may be required with the use of a round top surface 208 (e.g., circular, oval, oblong).

FIG. 2 is a top plan view of the device of FIG. 1. As described above, the top section 202 may be a substantially square (e.g., 12 inches square, or 14 inches square, or other dimensions as required) structure having the raised borders 206.

In some embodiments, the top surface 208 may be constructed or formed of a thin, yet durable, and lightweight wood or plastic (e.g., polymer or fiber reinforced plastic (FRP)) material. The material and construction should be able to support the partial body weight of a user via the user's upper extremities (e.g., hands or arms).

In an embodiment employing a thin wood or plastic/polymer material, the top surface 208 may also be used to produce a motivating auditory stimulus, such as a noise or rattle when impacted by a percussive force imposed by the user, a parent, or caregiver supervising the user. This aural stimulation may be achieved by tapping a finger or object on the top surface 208 to produce a drum-like sound or a rattle. As described in below in connection with FIG. 3, the top section 202 is not firmly held in place allowing it to move slightly when impacted, causing the rattle or vibration. The auditory stimulation of the intended user (e.g. an infant) may provide motivation to the infant and/or increased awareness and alertness.

FIG. 2 further shows the base perimeter 220, or footprint, in comparison to the top perimeter 213. As shown, the base perimeter 220 may be defined by an outer edge 238 of the feet 210. The base perimeter 220 (shown in dashed lines) may have a larger dimension than the top perimeter, providing the trapezoidal profile.

The support legs 216 are shown disposed at the four corners of the top section 202. The feet 210 may be oriented outward, away from a center 240 (indicated by a crosshair) of the top section 202. Orienting the feet 210 away from the center 240 increases the amount of unobstructed area under the device 200 while increasing the stability. Such an arrangement provides space under the device 200 (described in more detail in FIG. 4) for the user's legs during transitions from sitting on the floor to standing or walking while pushing the device 200 across the floor 212. This arrangement also provides increased stability and fewer tipping points. For example, if the user places increased force on a corner it will be less likely to tip because the support leg 216 is directly beneath the applied force.

Figure 3:
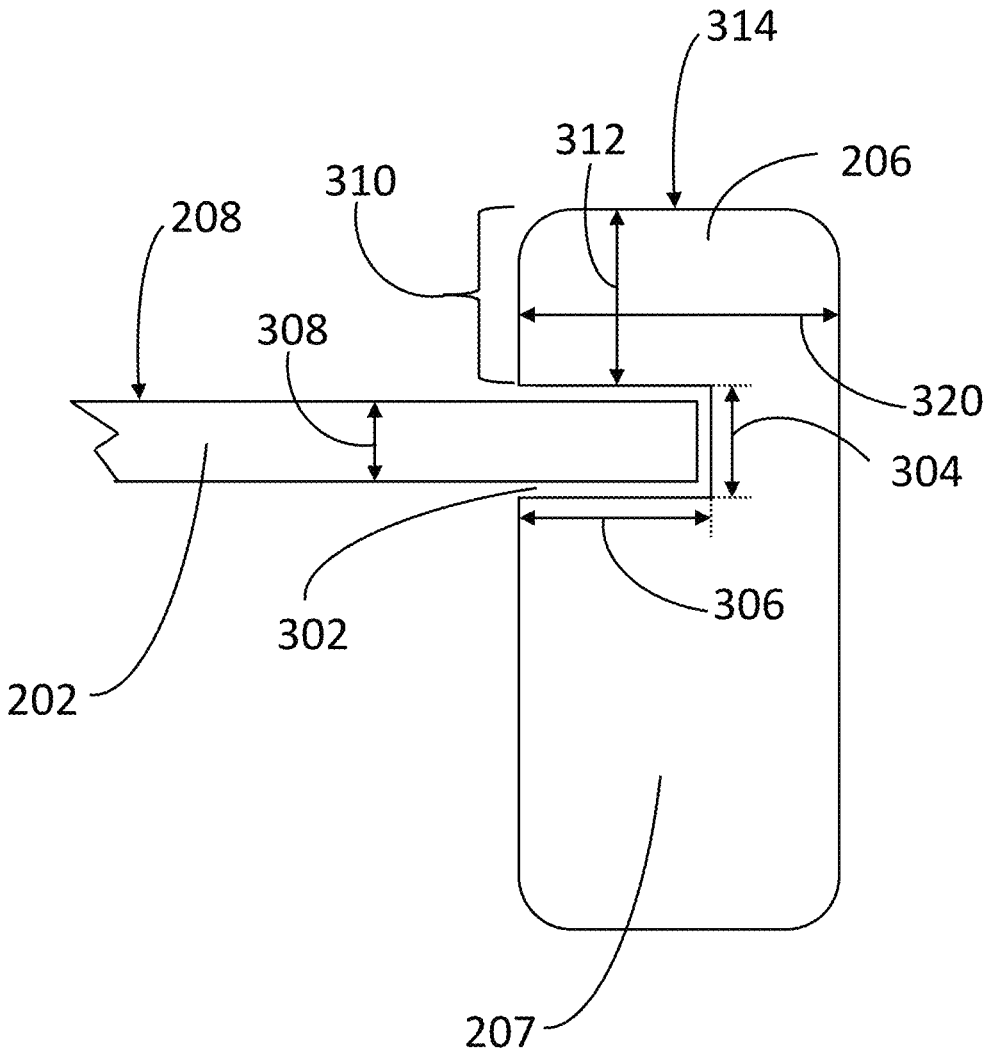
FIG. 3 is a sectional view of the device of FIG. 1.

FIG. 3 is a sectional view of the device of FIG. 1. The side supports 207 may be formed with a groove 302 formed along the length of the side supports 207. In some embodiments, the groove 302 sized to receive an edge 303 of the top section 202 in a clearance fit. The groove 302 may have a groove height 304 and a groove depth 306. The groove height 304 slightly larger than a top section width 308. The difference in dimensions may allow the top section 202 a small amount of movement within the groove 302. Accordingly, when impacted by a percussive force, the top section 202 is allowed to vibrate within the side supports 207 and create a rattling noise or vibration.

In an embodiment, the top section 202 is contained and supported within the groove 302 near the raised borders 206. The raised borders 206 may have a lip 310. The lip 310 may rise a lip height 312 away from the top section 202. The lip 310 surrounds the top surface 208 top section 202 at the raised borders 206. In some embodiments, the raised border 206 and lip 310 provide a place for the intended user to grip or grasp and control the device 200 in use. The raised borders 206 may further have a rounded top surface 314, and a border width 320 adding an element of comfort and safety of the device 200. The border width 320 may vary based on the size of the intended user and the degree to which the top section 202 is to be contained and supported within the groove 302.

In some embodiments, the raised border 206 may serve at least three primary functions. First, the lip 310 and rounded top surface 314 may provide a user with an area that can be grasped or manipulated by the fingers at the raised border 206. This may serve as added support to the intended user and the ability to stabilize their position, but also the ability to grip a type of handle and control the device 200.

Second, the lip 310 may provide a sense of confinement to the intended user. In some embodiments where the user is an infant or small child user may use his or her hands or forearms on the top surface 208 for support. The lip 310 may then prevent the hands or forearms from sliding off the raised borders 206.

In some other embodiments, the user's arms and hands are restricted to an area that is approximately the width of the user's body, depending on the construction and dimensions of the device 200 in use. This position of the upper extremities of the user allows for increased force production from the muscles to support and control of the user's trunk and pelvis.

Figure 4:
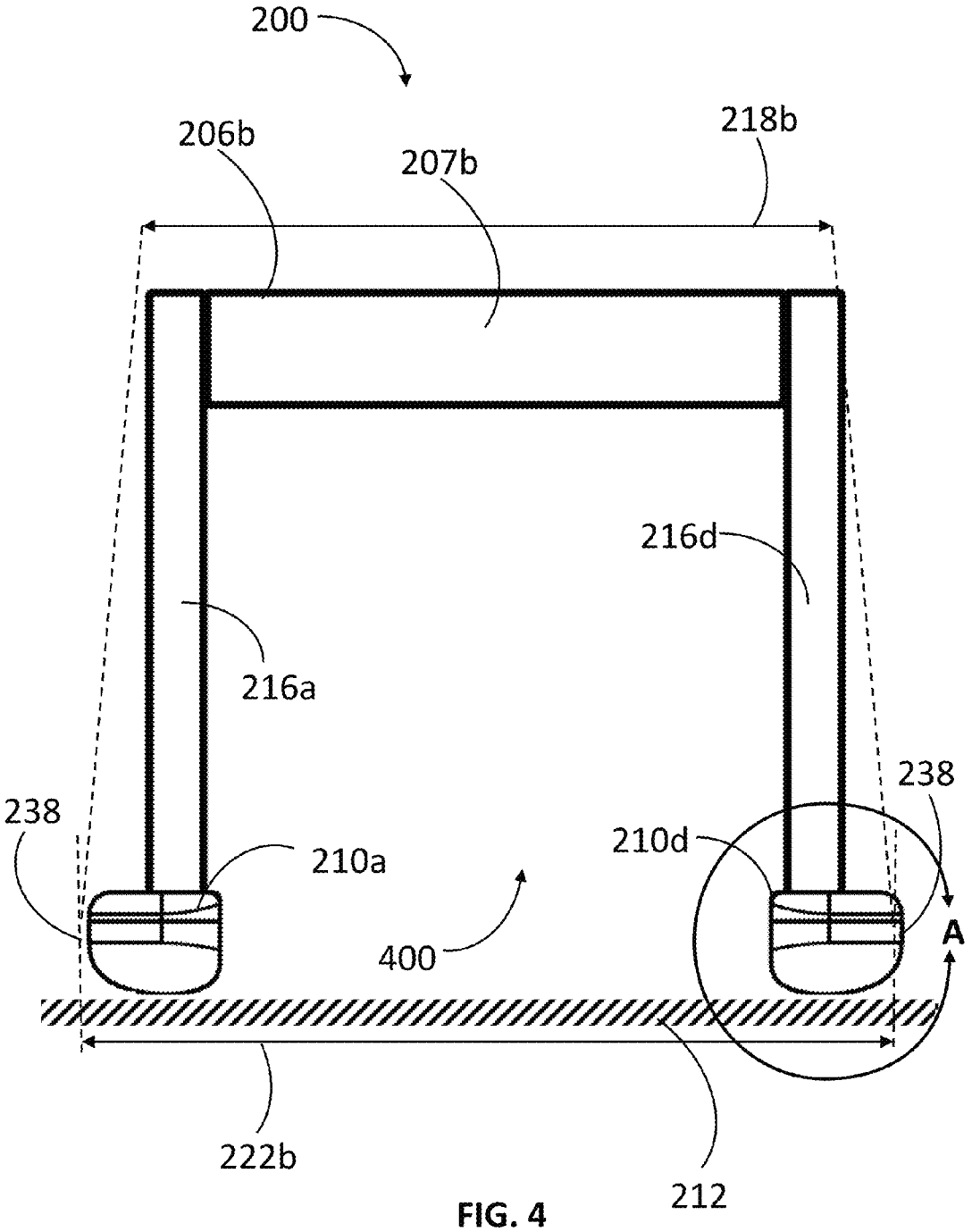
FIG. 4 is a side plan view of the device of FIG. 1.

FIG. 4 is a side plan view of the device of FIG. 1. As shown, the support legs 216*a* and 216*d* are formed or otherwise connected to the raised border 206B as shown. As noted above, the support legs 216 may be connected to the side supports 207 through the use of fasteners such as screws or bolts or by an interference fit (not shown). In the exemplary embodiment of FIG. 4, the support legs 216*a* and 216*d*, and the side support 207, and the floor 212 describe an open space generally designated 400. In an embodiment in which the support legs 216 are formed or otherwise attached to the ends 402 of the side supports 207, a maximum possible open space 400 is provided under the device 200. The open space 400 advantageously provides space to for the intended user to move his or her legs under the device 200 in use. This may allow a natural movement from a seated position next to the device 200 to a kneeling or a standing position over the device 200. The open space 400 also allows the intended user to take uninhibited steps forward (see also FIG. 8 and FIG. 11).

FIG. 4 further shows the base dimension 222*b* defined by the outer edges 238 of the feet 210. As noted above, the base dimension 222*b* is larger than the top dimension 218*b*, providing a trapezoidal profile. Accordingly, in some embodiments, the top perimeter 213 may be slightly smaller than the base perimeter 220. In an embodiment having four sides (as shown in FIG. 1-FIG. 4) the device 200 may further have a square pyramidal frustum shape, with the top perimeter 213 and the base perimeter 220 being separated in parallel planes by the support legs 216, with the top perimeter 213 having smaller dimensions than the base perimeter 220. In other words, a square pyramidal frustum may also be defined as a pyramid having a square base with the top removed or chopped off. Removing the top of a square pyramid results in a prismatoid shape having four equal trapezoidal sides with a square top smaller than the square base.

Figure 5:
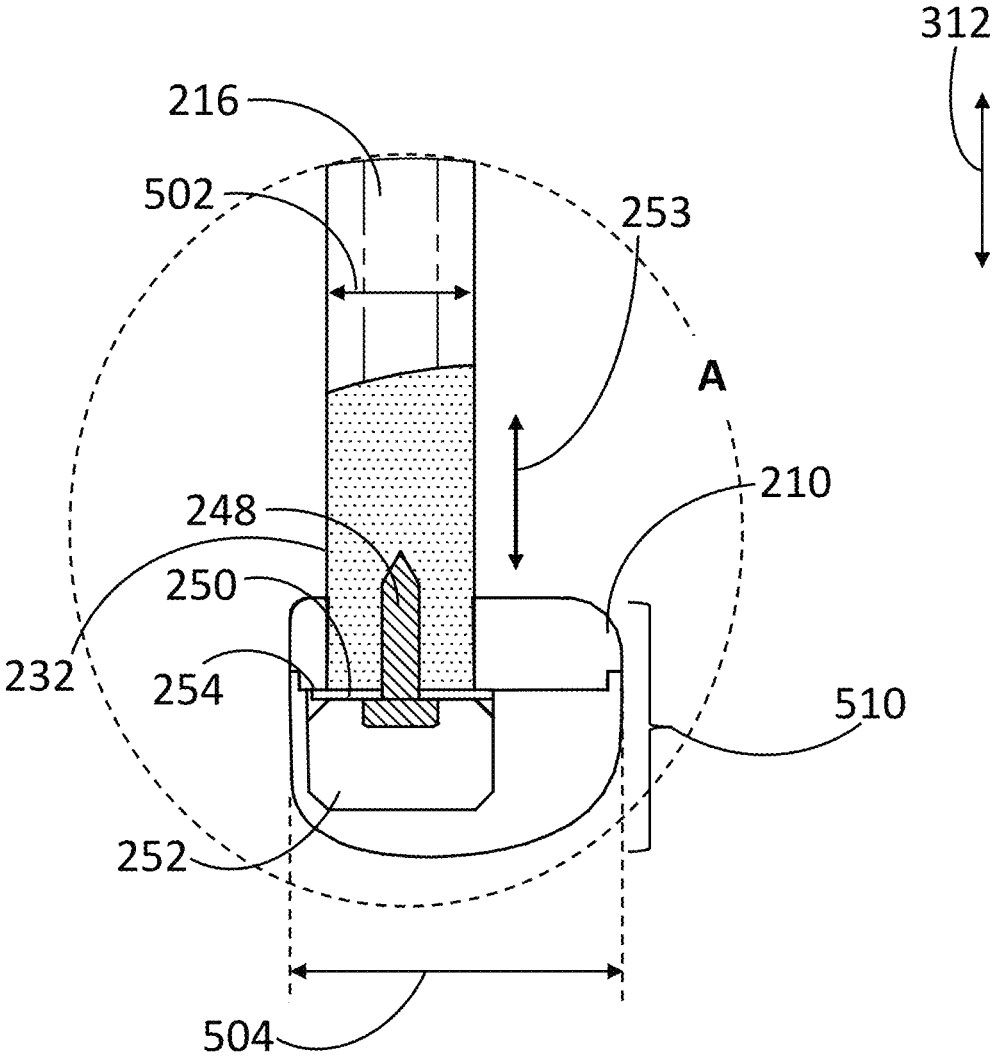
FIG. 5 is a sectional view of the device of FIG. 1.

FIG. 5 is a sectional view of the device of FIG. 1. The cross section of the foot 210*d* is taken from detail A of FIG. 4. The foot 210*d* may have a foot body 510. The foot body 510 joins the supporting leg 216 at the distal end 232. The foot body 510 may be joined to the distal end 232 of the support leg 216*d* using certain fasteners as described below.

The support leg may have a leg width 502. In an embodiment, for example, the support legs 216 may be approximately one inch. In some embodiments, the leg width 502 may be a diameter or one side of a substantially square support leg 216. In some other embodiments, the support legs 216 may be formed with a smaller or larger leg width 502 for different applications and different sized users. For example, in an embodiment of the device 200 for use with an adult user then the leg width 502 may increase above one inch (e.g., two inches to four inches or more) or even be constructed of aluminum or other metal or alloy construction to accommodate the increased loading on the top section 202.

In an embodiment, the foot body 510 may have a foot width 504. The foot width 504 may be larger than the leg width 502, thus foot body 510 and the feet 210 as a whole may have larger dimensions than the support legs 216. As described in FIG. 2, the feet 210 may be positioned and oriented outward, away from the center 240 of the device 200. Accordingly, a majority of the additional width, or the difference between the foot width 504 and the leg width 502 may extends outward from the distal end 232 of the support legs 216. As a non-limiting example, the foot body 510 may be one to two inches larger than the dimensions of a support leg 216, providing additional contact area with the floor 212. Accordingly, the base perimeter 220 may be 14 inches square (e.g., 56 inches) where the top perimeter 213 may be 12 inches square (e.g., 48 inches). By placing the additional foot width 504 toward the outside of the distal end 232 of the supporting leg 216, the open space 400 (FIG. 4) is maximized. Furthermore, the feet 210 do not become a possible obstruction or trip hazard to the intended user's as he or she walks.

The foot body 510 may be secured to the distal end 232 of the support leg 216 by a fastener 248 inserted through a stopper 250. The stopper 250 is formed with an aperture 262 (FIG. 6) sized to receive the fastener 248. The stopper 250 may provide a mounting surface 254 for the foot body 510 preventing the foot 210 from being removed from the distal end 232. In an embodiment, the fastener 248 may be formed with external threads (not shown) and used to secure the stopper 250 to the distal end 232 of the supporting leg 216. The supporting leg 216 may be formed with complementary internal threads to accommodate the external threads of the fastener 248 (e.g., a bolt or screw).

In some embodiments, the foot 210 has an internal compressible structure referred to as an internal cushion 252 to absorb vertical forces exerted on the top surface 208. The internal cushion 252 may be inserted and fit within the foot body 510 prior to installation and serve as a cushion or other compressible structure for absorbing shock from compressive forces acting on the top section 202. For example, such compressive forces may result from a user 100 leaning on the top of the device 200. The internal cushion 252 may be compressed by the user's bodyweight in use. The internal cushion 252 then serves to absorb such forces and allow the foot body 510 to move vertically a distance as the internal cushion 252 compresses along a vertical axis of the supporting leg in a direction represented by the arrow 253.

The foot body 510 may be formed of a polymer or hard plastic (e.g., nylon, polycarbonate) exhibiting a low friction when in contact with a hard floor, surface, and most carpets. As a non-limiting example, such a feature may allow the device 200 in use to slide easily from a hard floor (e.g., tile, linoleum, wood, concrete, or floors with similar characteristics) onto a soft floor such as carpet while simultaneously providing a stable platform. The term "low friction" in this sense is intended to indicate that a child user 100 may apply pressure to the top of the device 200 to easily slide the device 200 over various surfaces. For example, the coefficient of friction exhibited by the feet 210 on a hard floor may be between 0.1-0.3. Similarly, the coefficient of friction between the foot body and a carpeted floor may be in a range of 0.1-0.4. However, while the intent is to provide low friction, the feet 210 of device 200 are also intended to provide increased stability.

Figure 6:
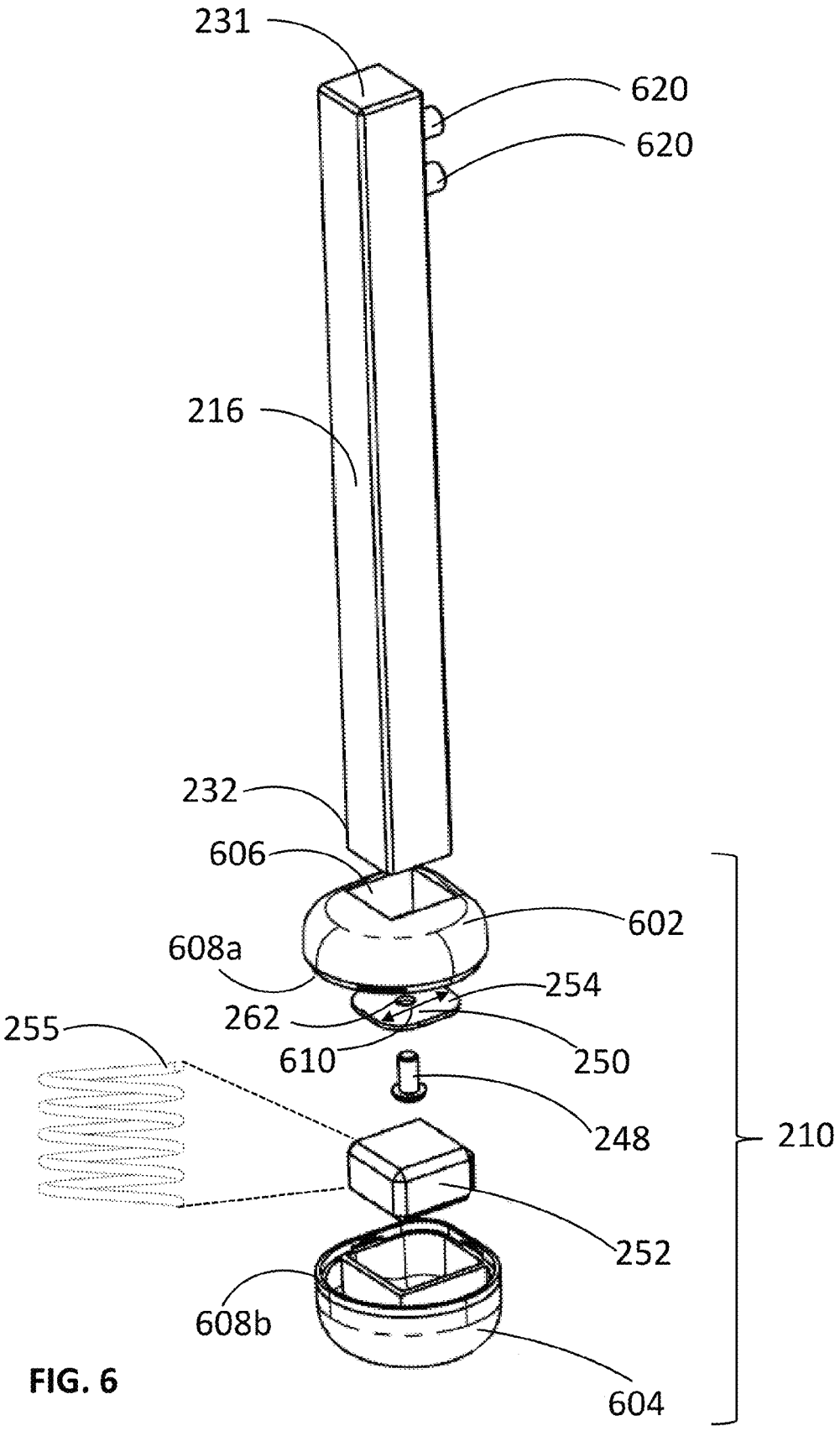
FIG. 6 is an exploded view of an embodiment of the supporting leg and foot of the device of FIG. 1.

FIG. 6 is an exploded view of an embodiment of the supporting leg and foot of the device of FIG. 1. In an embodiment, the foot body 510 may have an upper portion 602 and a lower portion 604 that encapsulate the other components of the foot 210.

The upper portion 602 may be formed having an aperture 606 sized to closely accept the distal end 232 of the supporting leg 216 in a clearance fit. The clearance fit allows the distal end 232 to move freely within the aperture 606 of the upper portion 602. The upper portion 602 and lower portion 604 may each be formed with a complementary peripheral latch 608*a*, 608*b* that secures or "snaps" the upper portion 602 to the lower portion 604 when installed. In an embodiment the upper portion 602 and lower portion 604 may be formed as a single component.

The upper portion 602 may be captured or secured in place by the stopper 250 and the fastener 248, the stopper 250 having larger dimensions than the aperture 606 of the upper portion 256. Once the lower portion 604 is secured to the upper portion 602, the foot body 510 may only travel a short distance as the internal cushion 252 is compressed. The internal cushion 252 may be formed of a spring 255, synthetic or elastomeric polymer foam, or other suitable compressible or elastic material. In an embodiment, the spring 255 may also add additional weight to the foot 210.

In an embodiment, the stopper 250 may be formed from a metallic material, such as steel, aluminum, or an appropriate alloy. The stopper 250 is formed with a stopper width 610 slightly larger than the leg width 502 (FIG. 5) of the distal end 232 of the supporting leg 216. The stopper 250 thus forms the mounting surface 254 (FIG. 5) around an outer perimeter (not shown) of the distal end 232. The mounting surface 254 may serve as an attachment point for the foot body 510 when installed. The stopper 250 may be increased in sized and correspondingly implemented as a weight. The additional weight in the feet 210 further lower the center of gravity of the device 200, decreasing a tipping moment.

In some embodiments, the lower portion 604 of the foot 210 may be formed with a hard, round-shaped base that comes in contact with the floor 212. In some embodiments, the lower portion 604 is formed having a hard, rounded surface enabling the device 200 to slide easily across various surfaces as the pushes the device 200 across the floor.

In an embodiment, when the user exerts a vertical or compressive force (e.g., pushes down) on the device 200 or otherwise places his or her weight on the top section 202 the force will transmit through the support legs 216 down into the internal cushion 252. The distal end 232 of the supporting leg 216 extending into the foot 210 is allowed to move within the foot body 510 as the compressible foam material of the internal cushion 252 is compressed. This construction provides a type of shock absorber and stabilizing mechanism and may keep the device 200 from moving while the user (e.g., an infant) in transitioning their weight from a sitting to a kneeling to a standing posture. The additional weight of the stopper 250 and the internal cushion 252 positioned in the bottom of the device 200 further increase the overall stability of the device 200 and prevents the device 200 from tipping over.

In an embodiment, the compressible nature of the internal cushion 252 further provides a sense of compression and increased proprioception stimulation to the user's 202 muscles and joints, in turn providing additional motor learning.

In another embodiment, in use a user may slide the device 200 across a hard floor 212 (e.g., hardwood, tile, or linoleum) or a carpeted floor 212. The "low friction" nature of the foot body 510 as described herein, can provide a predictable and relatively constant coefficient of friction whether the device is being used on a hard floor 212 or a carpeted floor 212. Additionally, the internal cushion 252 can further allow the feet 210 to move slightly allowing device 200 to glide over imperfections in the floor 212, such as a transition between a hard floor and a carpeted floor, bumps in tile grouting, or similar obstacles.

In some embodiments, the proximal end 231 of the support leg 216 may be formed to join with the side supports 207. The proximal end 231 may be formed with compression fittings 620. The compression fittings 620 may be complementary male and female fittings. The compression fittings 620 may be formed to join with the side support 207 in an interference fit. The proximal end 231 may further be formed to join the side support 207 through the use of various fasteners (e.g., bolts, screws, etc.). The proximal end 231 may further be formed with a groove that is complementary to the groove 302 (FIG. 7) and formed to receive the edge 303 of the top section 202.

Figure 7:
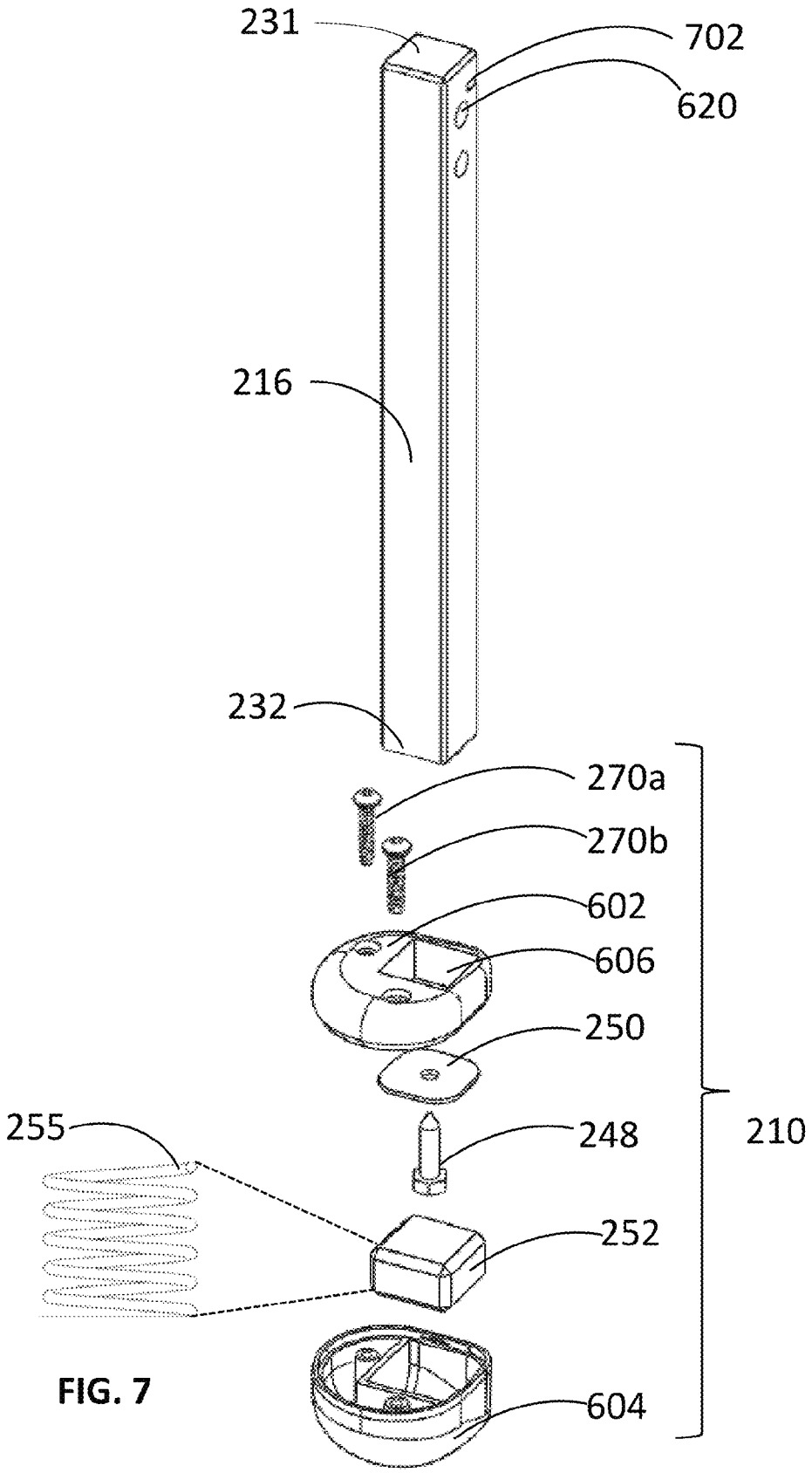
FIG. 7 is an exploded view of another embodiment of the supporting leg and foot of the device of FIG. 1.

FIG. 7 is an exploded view of another embodiment of the supporting leg and foot of the device of FIG. 1. As shown, the components of the embodiment shown in this figure are largely similar to those shown in FIG. 6. In some embodiments, additional fasteners 702*a*, 702*b* may be incorporated in the foot 210. The fasteners 702*a*, 702*b* may further secure the upper portion 602 to the lower portion 604. In an embodiment, the foot body 510 may have both the peripheral latch 608 (FIG. 6) and the fasteners 702*a*, 702*b*. This type of construction may allow for flexibility in design, further allowing the removal and/or replacement of the internal cushion 252. Due to the shock absorbing nature of the internal cushion 252 (or the spring 255), it may wear over time and require replacement.

As noted above, the support leg 216 may be formed with a groove 702, complementary to the groove 302 (FIG. 3). The groove 702 may have similar dimensions to the groove 302 and function in a similar manner. The edges 303 of the top surface 202 may be contained and supported by the grooves 702 while allowing a small amount of movement, similar to the side supports 207.

In some embodiments, the supporting leg 216 may be formed as a unitary or monolith construction and further incorporate a cushion within the design serving the same shock-absorbing function as described. Such a monolith construction may be injection molded. Further alternative embodiments may incorporate a non-linear profile (not shown) along the length of the supporting leg 216 allowing for a larger leg width 502 at the distal end 232 of the supporting leg 216 than at a proximal end 231 of the supporting leg 216. This may allow for a heavier, more stable construction concentrating mass of the construction and center of gravity closer to the distal end 232 of the support leg 216 and the foot 210.

Figure 8:
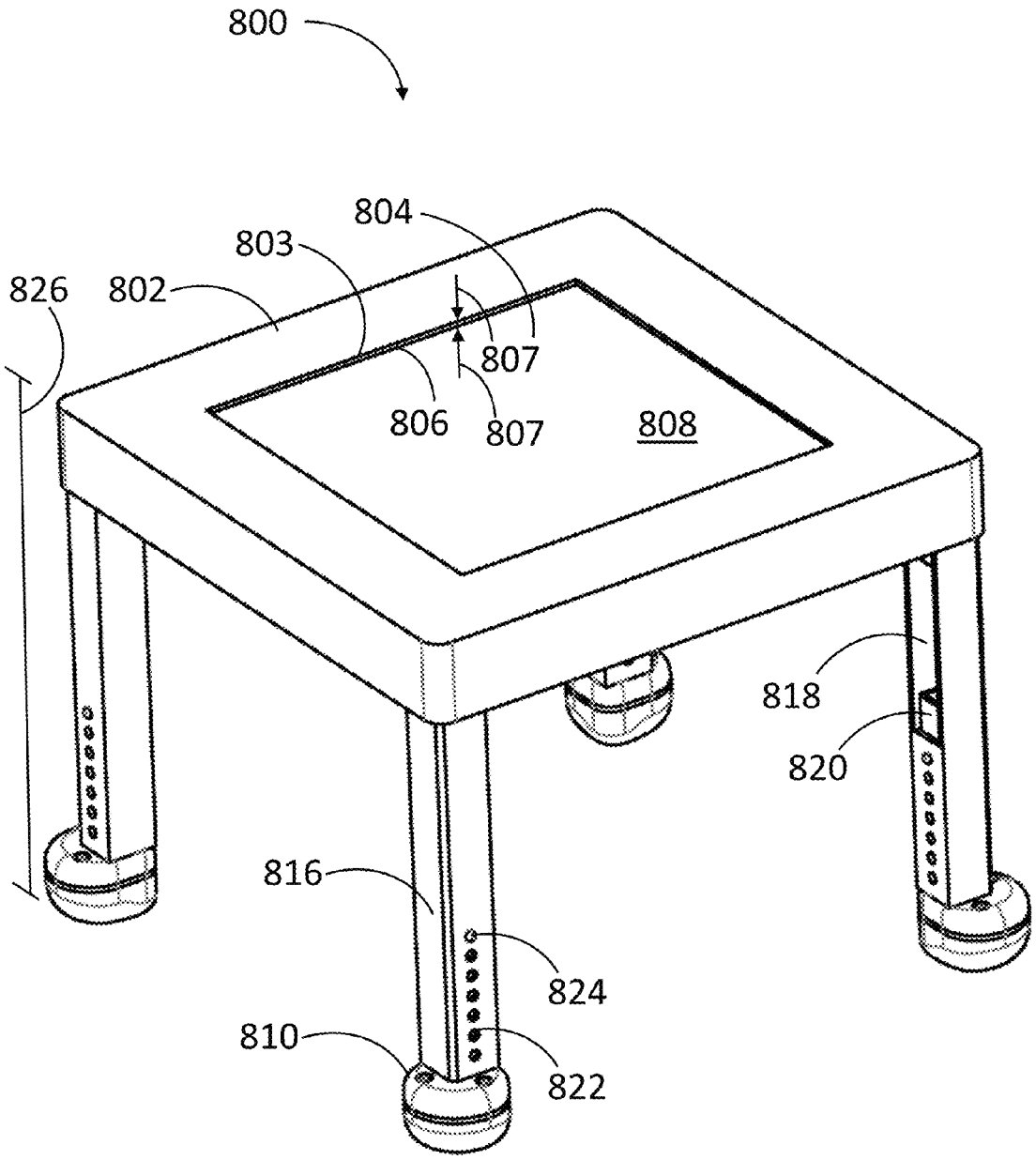
FIG. 8 is a perspective view of another embodiment of a device for assisted walking.

FIG. 8 is a perspective view of another embodiment of a device for assisted walking. As shown, a device 800 may be similar to the device 200 of the previous figures. The device 800 may have a top frame 802. The top frame 802 may have similar features as the raised borders 206 (FIG. 2) but be cast as a single component. Accordingly, the top frame 802 may be formed through an injection molding process or similar method. The top frame 802 may have a central aperture 803 sized to accept a top section 804. The top section 804 may be formed similar to the top section 202 (FIG. 2). In an embodiment, the top section 804 may be a clear or translucent material that forms the top of the device 800. The top section 804 may thus be constructed from polycarbonate, acrylic, clear acrylonitrile butadiene styrene (ABS), or other clear composites with similar characteristics. The top section 804 may also be constructed of other opaque materials.

In an embodiment, the top section 804 may be secured in place from underneath, as described below in connection with FIG. 9A and FIG. 9B. In some embodiments, the top section 804 may have some freedom to move and therefore be configured to provide an auditory stimulus, for example, a thump or a rattle similar to FIG. 2, when impacted with a percussive force.

In some embodiments, the device 800 may further have a lip 806. The lip 806 may be similar to the lip 310 (FIG. 3), providing an area to grip or grasp the device 800. The lip 806 may have a lip height similar to the lip height 312 (FIG. 3) indicated by the arrows 807. The device 800 may also have a top surface 808 similar to the top surface 208 (FIG. 1)

The device 800 may further have support legs 816*a*-816*d* (collectively referred to hereinafter as "support legs 816"). The support legs 816 may have similar dimensions and serve the same purposes as the support legs 216, described above. In some embodiments, the support legs 816 may be adjustable. As shown, the support legs 816 may have an upper portion 818 and a lower portion 820. The upper portion 818 may have a hollow construction and an internal space sized to receive the lower portion 820 with a clearance fit. The upper portion 818 may also be formed with a series of adjustment holes 822 sized to accept a quick release button 824. This is described further in connection with FIG. 10.

Figure 9A:
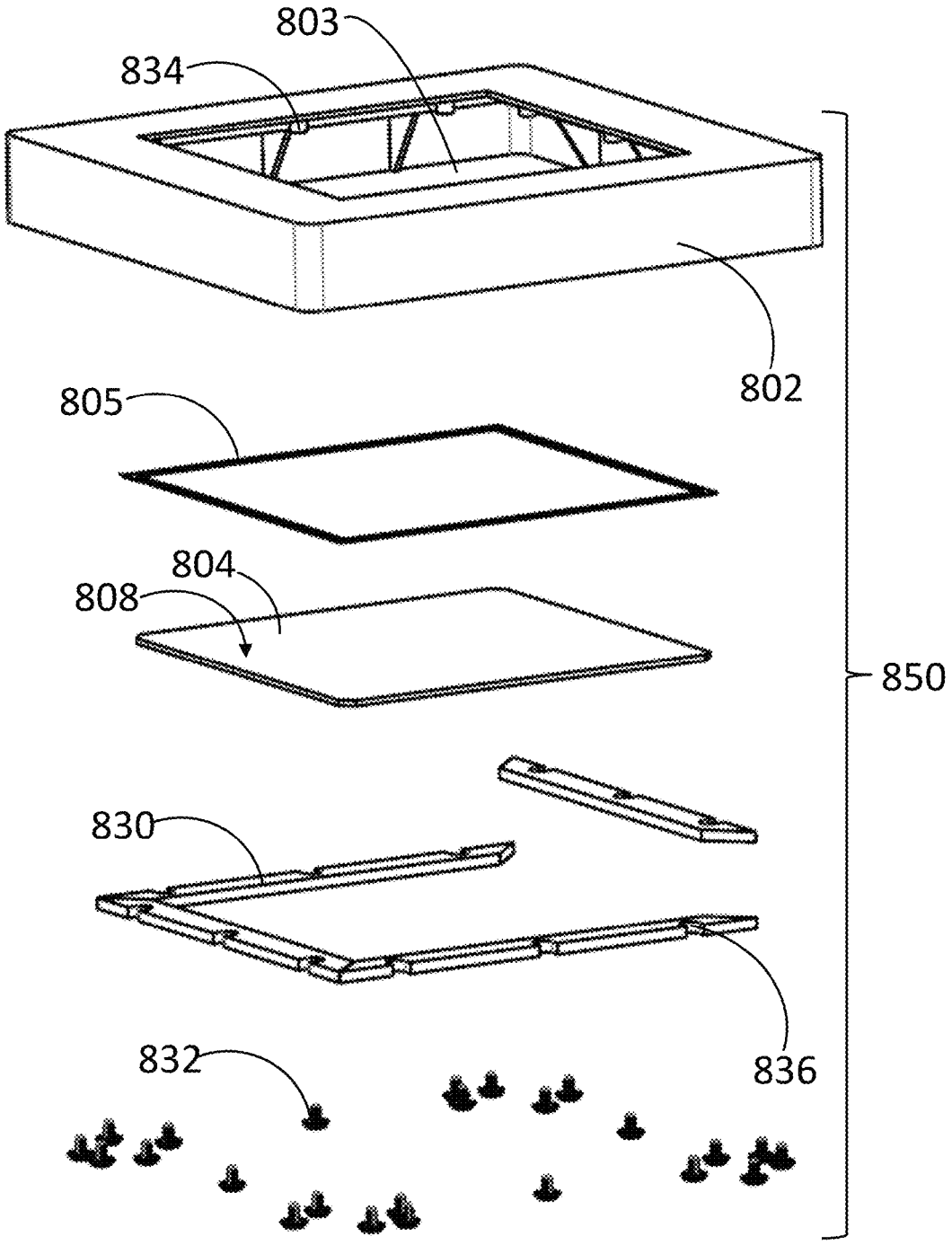
FIG. 9A is an exploded view of a top section of the device of FIG. 8.

FIG. 9A is an exploded view of a top section of the device of FIG. 8. The device 800 may have a top portion 850. The top portion 850 may be formed of fewer components that the device 200 (see FIG. 1) without sacrificing functionality. The top portion 850 may comprise the top frame 802, the top section 804 and a gasket 805, therebetween. The device may further have one or more brackets 830. The brackets 830 may be in sections as shown (e.g., four sections) and be formed with a plurality of apertures 826. The apertures 826 are size to receive the fasteners 832 and secure the top section to the top frame 802. The top frame 802 may be formed with multiple holes 834 sized to accept the fasteners 832 that secure each of the brackets 830 in place on the underside of the top frame 802. In some embodiments the gasket 805 is not present. The top frame 802 may be rectangular or square in shape, similar to the device 200.

Figure 9B:
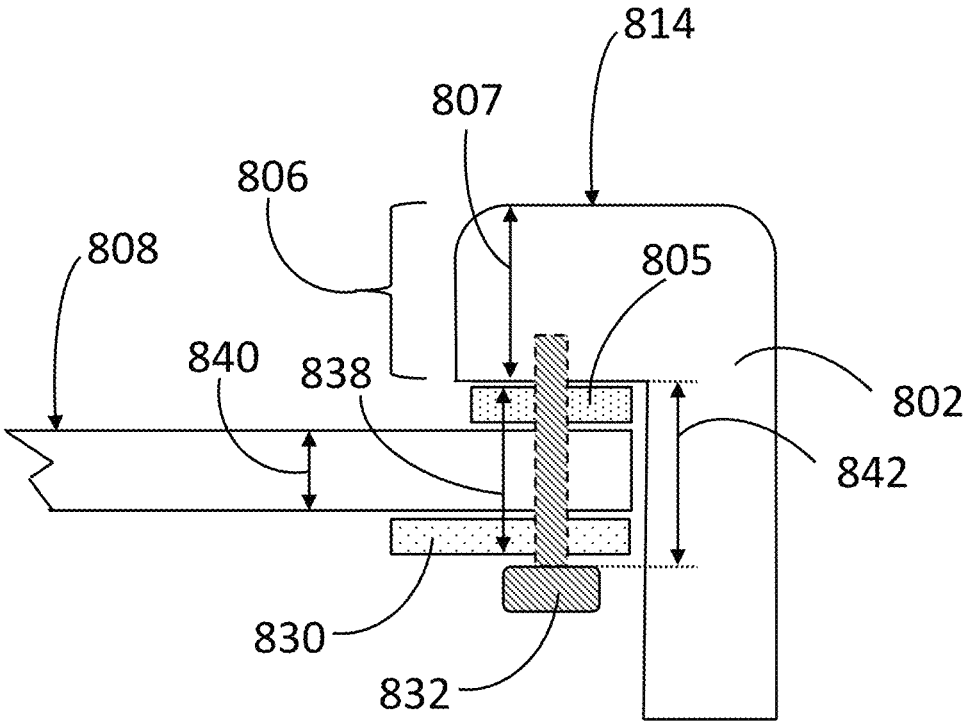
FIG. 9B is a sectional view of the device of FIG. 8.

FIG. 9B is a sectional view of the device of FIG. 8. As noted above, the top section 804 may be secured to the top frame 802 from underneath with the use of the brackets 830 and the fasteners 832.

The top frame 802 may be formed with rounded upper surface 814. The rounded upper surface 814 may be similar to the rounded top surface 313 (FIG. 3) and provide a comfortable area to grasp and control the device 800. The upper surface 814 may rise the lip height 807 that defines the lip 806. The lip 806 may be and additional distance from the top surface 808 of the top section 804 when the gasket 805 is present. Accordingly, the gasket 805 may be optional.

The top section 804 may have a top section width 840, similar to the top section width 308 (FIG. 3). Each of the fasteners 832 may be inserted through the holes 836 (FIG. 9A) in the bracket 830 and screwed or otherwise set into the holes 834 (FIG. 9A) in the top frame 802. Similar to the device 200, the top section 802 may be allowed some degree of movement when secured by the brackets 830. The movement may be allowed when a distance 842 allows a close clearance fit between the bracket 830 and the top frame 802. The brackets 830 may contain and support the top section 804 but only be secured to a point at which the distance 842 is still slightly larger than a combined width 838 of the gasket 805, the top section 804, and the bracket 830. This may allow the top section 804 to move slightly and rattle within the bracket 830 and top frame 802 when struck by a percussive force.

Figure 10:
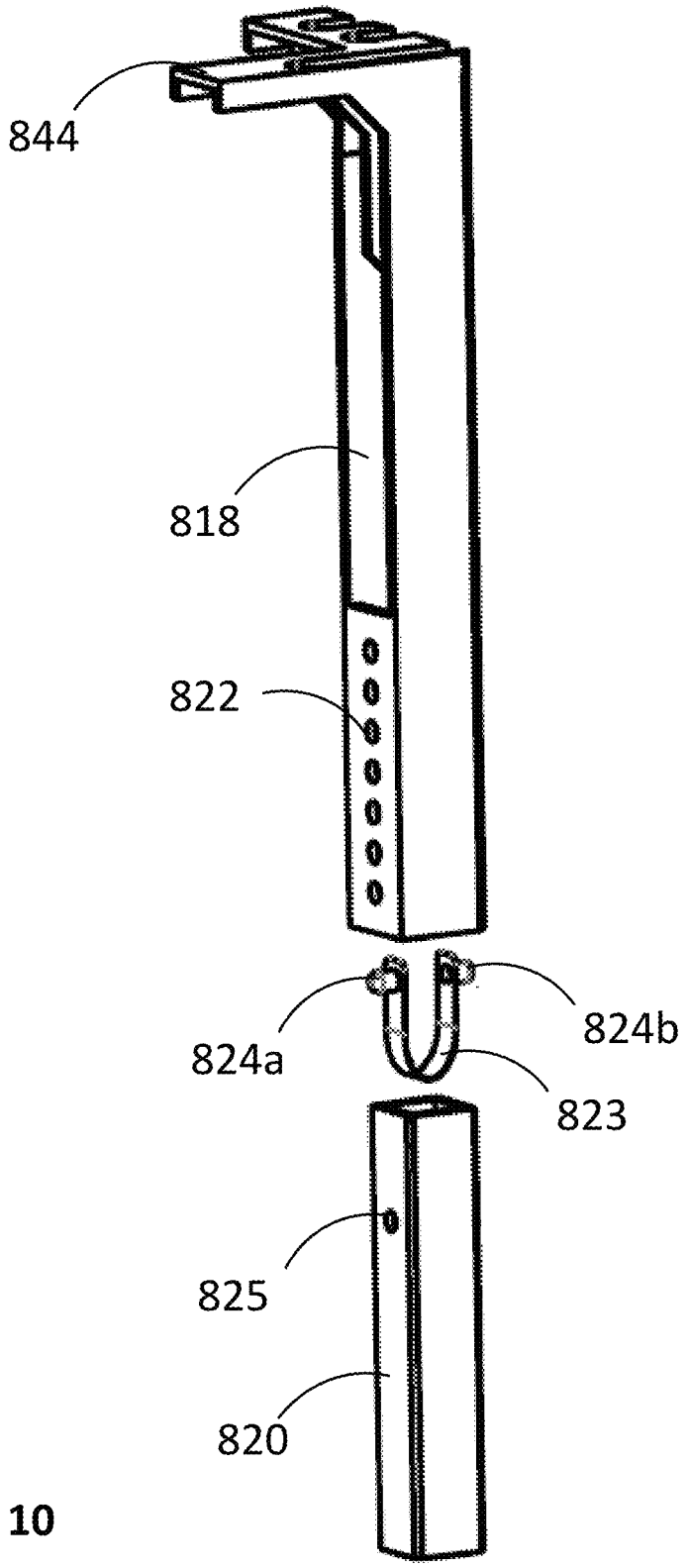
FIG. 10 is an exploded view of a support leg of the embodiment of FIG. 8.

FIG. 10 is an exploded view of the support legs of the device of FIG. 8. As shown, the support legs 816 may comprise the upper portion 818 and the lower portion 820. The lower portion may have a spring-loaded quick release buttons 824*a*, 824*b* inserted for use in adjusting the height 826 of the device 800. The quick release buttons 824*a*, 824*b* may be connected by spring piece 823 that holds the quick release buttons 824*a*, 824*b* in place within a pair of holes 825 in the lower portion 820. Only one of the holes 825 is visible in this view, however a corresponding hole 825 may be formed on the opposite side of the lower portion 820 to receive the quick release button 824*b*. The quick release buttons 824*a*, 824*b* may be compressed and inserted into the hollow center of the lower portion 820 with quick release buttons 824 protruding outward from the holes 825 and being held in place by the spring piece 823.

The lower portion 820 may be inserted into the hollow center of the upper portion 818 to adjust a height 826 of the support legs 816 and of the device 800. The quick release buttons 824*a*, 824*b* may be depressed within the lower portion 820 and moved to select a desired adjustment hole 822 in the upper portion 818. In use, the quick release buttons 824*a*, 824*b* may pass through the holes 825 in the lower portion and through the selected adjustment holes 822 in the upper portion 818 to adjust the height 826 (FIG. 8) of the support legs 816. In some embodiments, each of the support legs 816 may be adjusted to the same (e.g., equal) height 826 in use.

Each of the support legs 816 may further have a support section 844 configured to be secured to the top frame 802 using fasteners (not shown) similar to the fasteners 832 (FIG. 9A and FIG. 9B).

Figure 11:
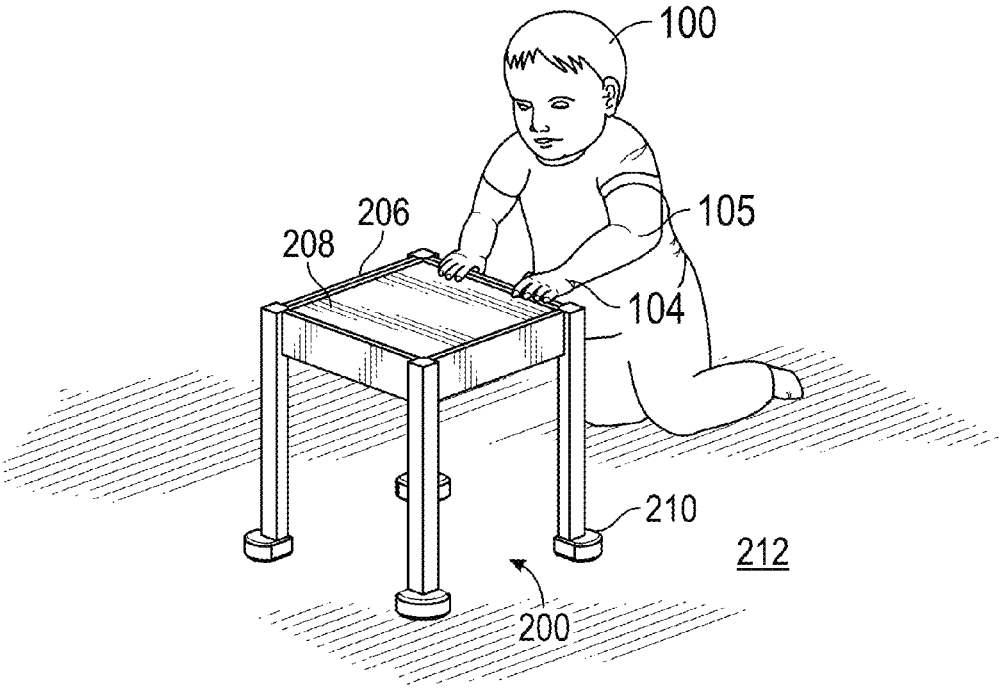
FIG. 11 is a perspective view of a user kneeling with the device of FIG. 1.

FIG. 11 is a perspective view of a user kneeling with the device of FIG. 1. A user 100 is shown using the device 200 in the developmental process of learning to walk. In an embodiment, the user 100 may be a toddler or infant learning to walk. Alternatively, the user 100 may be an adult undergoing physical therapy or occupational therapy related to their walking skills and/or balance. As shown, the user 100 is kneeling adjacent to a device 200. The device 200 is described in relation to this figure, however the device 800 may also be used in such a manner. The user 100 may push the device 200 while on his or her knees, similar to crawling, or use the device 200 as support for pushing up to a standing posture.

As shown in FIG. 11, the user 100 may place his or her hands 104 on one of a plurality of raised borders 206 (FIG. 2) of the device 200. The elevated characteristics of the raised borders 206 may provide a variety of grip options as the user 100 utilizes the device 200. The user 100 may further freely and independently place his or her hands 104 or arms 105 anywhere on a top surface 208 of the device 200. The various possible hand 104 positions available to the user 100 provide increased options for grip and balance while eliminating many of the safety concerns of a push walker with fixed handles. The freedom of selection of grip and hand placement options also provides a mechanism allowing the user 100 to steer the device in a desired direction, an advantage not available from a supported walker or push walker with fixed wheels and fixed hand grips. The size and depth (e.g., the lip 310, the lip height 312, and border width 320 of FIG. 3) of the raised borders 206 may further provide various grip and support options for the user 100 learning to walk.

The device 200 may be formed or otherwise constructed such that there is a manageable amount of friction between the feet 210 and the floor 212, regardless of the composition of the floor 212. As the user 100 positions himself or herself beside and/or over the device 200, the friction between the feet 210 and the floor 212 may allow the user 100 to slide the device 200 across the floor 212 as desired. However, the amount of friction between the feet 210 and floor 212 is also sufficient to prevent the device 200 from sliding out from under the user 100 as a push walker with wheels might. This may be achieved through use of a hard rounded surface on the bottom of each of the feet 210. As noted above, the feet may be constructed of various kinds of plastics, nylon, polycarbonate (PC), ABS+PC, acetal, or other polymers with the desired characteristics.

Figure 12:
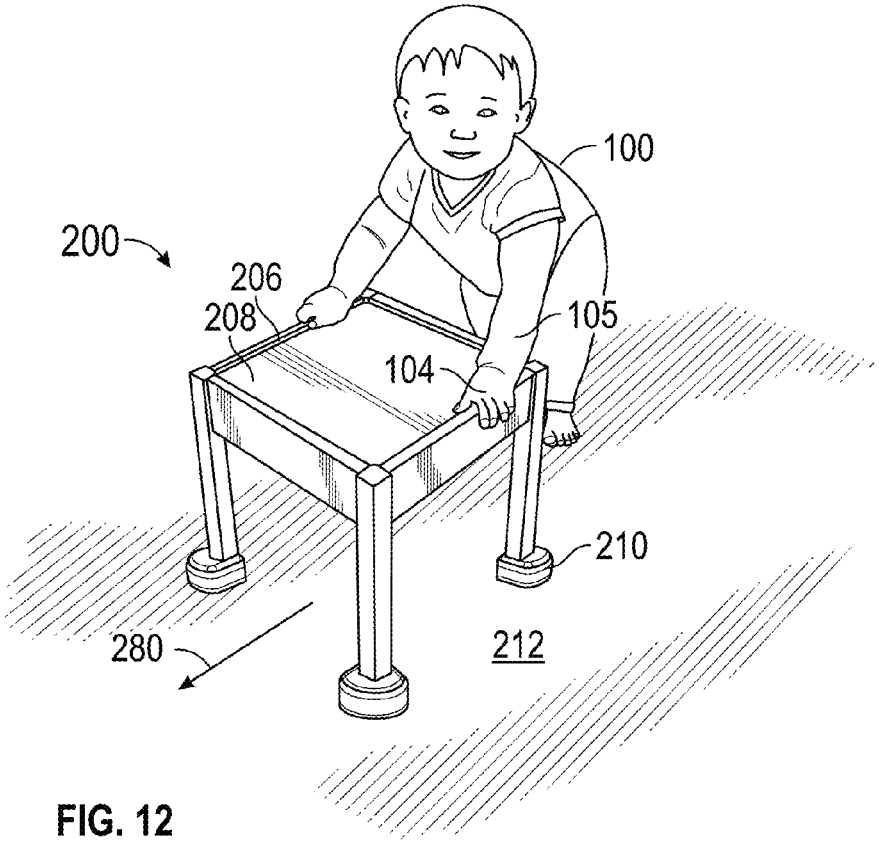
FIG. 12 is a perspective view of a user standing with the device of FIG. 1.

FIG. 12 is a perspective view of a user standing with the device of FIG. 1. In some embodiments, the user's hands 102 may further be placed on the flat top surface 208 of the of the device 200, or on the raised borders 206 as shown as the user transitions to a standing position adjacent to the device 200. The flat top surface 208 provides additional options as the user 100 may use their forearms for stability as needed.

In an embodiment, the user 100 may use the raised borders 206 to transfer their weight onto the hands 104 and arms 105 to transition into standing position from a seated position (not shown) or a kneeling position as shown in FIG. 11. The hands 104 and forearms 105 can freely move around during the process to counterbalance the body as it is changing positions. The device provides a variety of places for the user to place their hands allowing a variety of grip positions providing increased stability based on the strength, range of motion, and coordination of the user 100.

In an embodiment, once the user 100 has established sufficient balance he or she may stand completely as shown, allowing the user 100 to push the device 200 horizontally as it slides against the floor 212 in a direction 280. The friction provided by the shape of the feet 210, the materials used to construct the feet 210, and the resulting coefficient of friction between the feet 210 and the floor 212 create a relatively constant amount of friction regardless of the composition of the floor 212. The relatively constant amount of friction provide a predictable platform for the user 100 whether the device is being used on carpet or on a hard floor 212. Accordingly, the device 200 has a low probability of binding up on carpet or sliding out from under the user 100.

What is claimed is:

1. A device for assisted walking, comprising:

a substantially flat top section having a plurality of corners, a plurality of sides, and a first perimeter;

a raised border formed about the first perimeter, the raised border defining a top perimeter greater than the first perimeter;

a plurality of support legs, each support leg of the plurality of support legs disposed at each of the plurality of corners, the plurality of support legs extending in substantially the same direction away from the top section and each of the plurality of corners, the plurality of support legs each having a leg width;

a plurality of feet, each foot of the plurality of feet disposed at a distal end of an associated one of the plurality of support legs, the distal end being distal to the top section, each foot of the plurality of feet having a rounded bottom portion, each rounded bottom portion having foot width greater than the leg width, each foot extending out from the associated one of the plurality of support legs and extending more in a direction away from a center of the device than in the opposite direction such that more of the rounded bottom portion lies outside the top perimeter than inside the top perimeter to define a base perimeter greater than the top perimeter, the rounded bottom portion configured to slide along the floor.

2. The device of claim 1, further comprising a plurality of side supports, the plurality of side supports being equal to the plurality of sides, two or more of the plurality of side supports each having a groove, wherein the top section extends into the groove of each of the two of more side supports in a clearance fit, the clearance fit permitting the top section to rattle within the groove.

3. The device of claim 2, wherein the top section is formed from one of wood, polymer, and fiber reinforced plastic.

4. The device of claim 1, wherein each foot has a rounded top portion, the rounded top portion being formed with an aperture sized to receive the distal end of one of the support legs of the plurality of support legs.

5. The device of claim 4, wherein the rounded top portion is coupled to the rounded bottom portion to surround an internal compressible structure.

6. The device of claim 4, wherein the foot comprises an internal compressible structure covered by a top section, the internal compressible structure being configured to absorb a vertical force applied to the plurality of support legs, and allow the foot to move along a longitudinal axis of the support leg.

7. The device of claim 6 wherein the internal compressible structure comprises a spring.

8. The device of claim 6 wherein the internal compressible structure comprises an elastomeric polymer foam.

9. The device of claim 1, wherein the top section has a substantially square shape, each side of the top surface measuring between 10 and 26 inches; and wherein the support legs have a height of 12 to 30 inches.

10. The device of claim 1, wherein the feet and support legs have a unitary construction.

11. The device of claim 1, wherein the support legs comprise an upper leg portion formed to receive a lower leg portion and a quick release button configured to set an adjustable leg length.

12. The device of claim 1, wherein the bottom portion of the foot has a coefficient of friction less than 0.4 when in contact with the floor.

13. The device of claim 1, wherein the bottom portion of the foot comprises one of acrylonitrile butadiene styrene, nylon, and polycarbonate.

14. A method for training an infant to walk, comprising:

gripping a raised border of a walker device, the walker device comprising:

a substantially flat top surface having a plurality of corners and a first perimeter;

the raised border formed about the first perimeter, the raised border having a first width and defining a top perimeter greater than the first perimeter;

a support leg disposed on a bottom side of the top surface extending downward from each of the plurality of corners, the support leg having a leg width; and a foot disposed at a distal end of the support leg, each foot having a rounded bottom portion in contact with a floor, each bottom portion having foot width greater than the leg width, and defining a base perimeter greater than the top perimeter, the rounded bottom portion exhibiting a low friction relationship with the floor;

pulling the upper body up toward the edge as the infant stands up;

leaning on the top surface with hands or arms;

transferring the bodyweight of the infant to the hands or arms in contact with the top surface; and pushing the walker device along the floor.

15. The method of claim 14, further comprising tapping on the top surface to make a noise.

16. The method of claim 14 further comprising independently pushing the device from a hard floor surface to a carpeted surface.

17. A device for assisted walking, comprising:

a substantially flat top section having four of corners, four sides, and a first perimeter;

a raised border formed about the first perimeter, the raised border defining a top perimeter greater than the first perimeter;

four side supports configured to contain and support the top section, two or more of the four side supports having inner grooves, wherein the top section extends into the inner grooves in a clearance fit, the clearance fit permitting the top section to rattle within the groove when impacted by a percussive force;

four support legs, each of the four support legs disposed at each of the four corners, the four support legs extending downward from the top section and each of the four corners, the four support legs each having a leg width;

four feet, each of the four feet disposed at a distal end of each of the four support legs, the distal end being distal to the top section, each of the four feet having a rounded bottom portion in contact with a floor, each rounded bottom portion having foot width greater than the leg width and extending away from a center of the device to define a base perimeter greater than the top perimeter, the rounded bottom portion configured to slide along the floor.

18. The device of claim 17, wherein the foot is configured to move a distance along a longitudinal axis of the support leg from the distal end, the foot further comprising an internal compressible structure configured to absorb a vertical force applied to the top surface.

19. The device of claim 18, wherein the feet further comprise a top portion coupled to the rounded bottom portion, surrounding the internal compressible structure.

20. The device of claim 17, wherein the support legs are adjustable in height.

* * * * *